United States Patent [19]

Weiss

[11] Patent Number: 4,627,182

[45] Date of Patent: Dec. 9, 1986

[54] BI-STABLE DISPLAY DEVICE

[75] Inventor: Gerhart Weiss, Flushing, N.Y.

[73] Assignee: Tempo Instrument Incorporated, Commack, N.Y.

[21] Appl. No.: 740,923

[22] Filed: Jun. 3, 1985

[51] Int. Cl.[4] ..... G09F 3/04

[52] U.S. Cl. ..... 40/447; 40/450; 40/449; 40/466; 40/495

[58] Field of Search ..... 315/55, 169.3, 169.4; 40/447, 450, 451, 452, 463, 466, 474, 493, 495

[56] References Cited

U.S. PATENT DOCUMENTS

| | | | |
|---|---|---|---|
| 755,272 | 3/1904 | Burnham | 40/450 |
| 1,357,457 | 11/1920 | Jorgensen | 40/450 |
| 3,054,004 | 9/1962 | Lord | 315/55 |
| 3,072,821 | 1/1963 | Yando | 315/55 |
| 3,504,214 | 3/1970 | Lake | 315/169 |
| 3,928,466 | 12/1975 | Arail et al. | 40/466 |
| 4,040,193 | 8/1977 | Matsuda | 40/449 |

FOREIGN PATENT DOCUMENTS

| | | | |
|---|---|---|---|
| 658357 | 6/1929 | France | 40/447 |

*Primary Examiner*—Gene Mancene
*Assistant Examiner*—Wenceslao J. Contreras
*Attorney, Agent, or Firm*—Blum Kaplan Friedman Silberman & Beran

[57] ABSTRACT

A display device for use in constructing remote controlling billboards, bus destination signs, and the like has a two-sided display disc which is carried on a pivoted support. The display disc is rotated by the application of force from a piezoelectric crystal drive to a point on the support which is off of the axis of rotation of the support. The crystal drive responds to DC voltage of one polarity or the other to rotate the display disc to expose a dark side or a light side to the viewer.

47 Claims, 26 Drawing Figures

FIG. 1
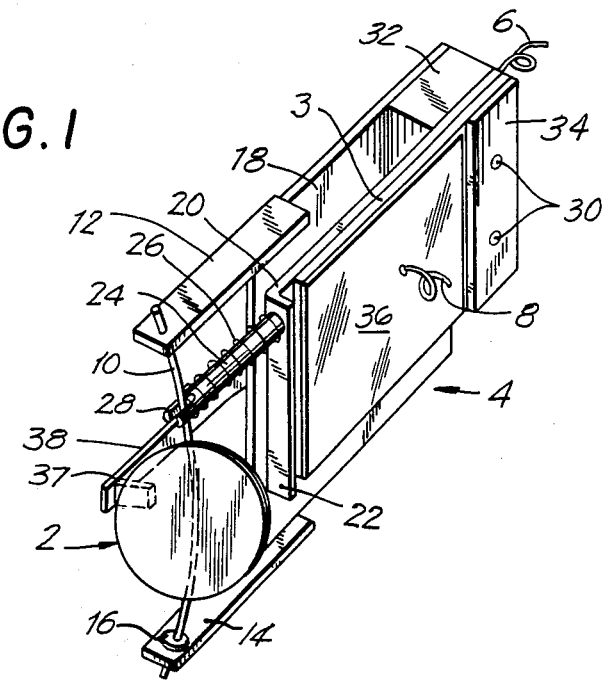
FIG. 2
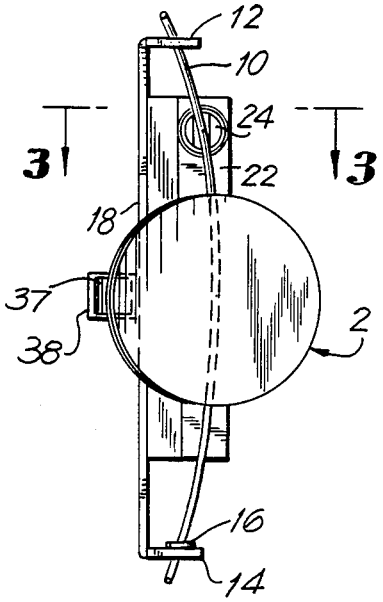
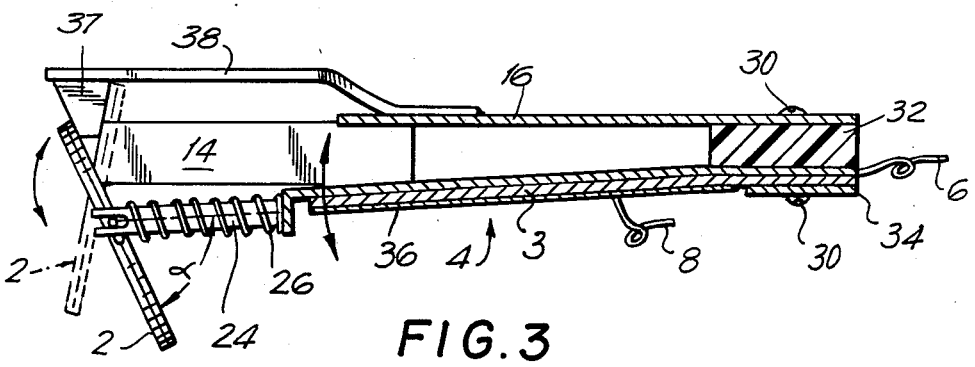
FIG. 3

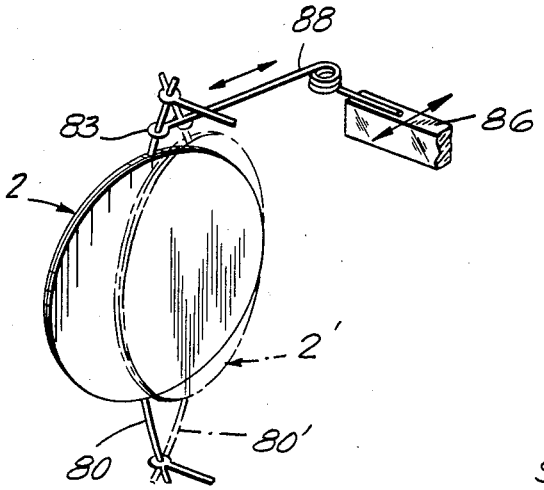
FIG. 8
FIG. 9A
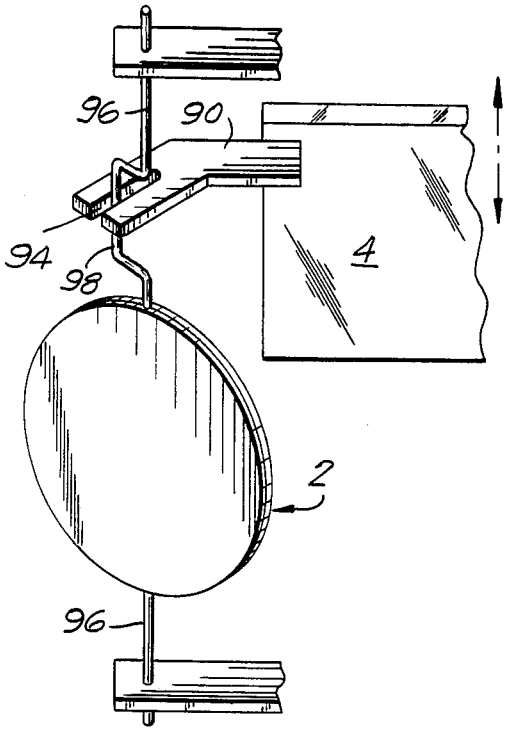
FIG. 9B
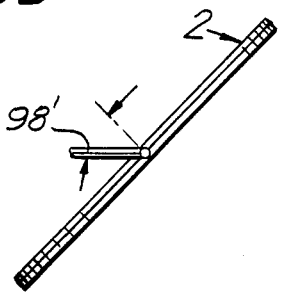

FIG. 10
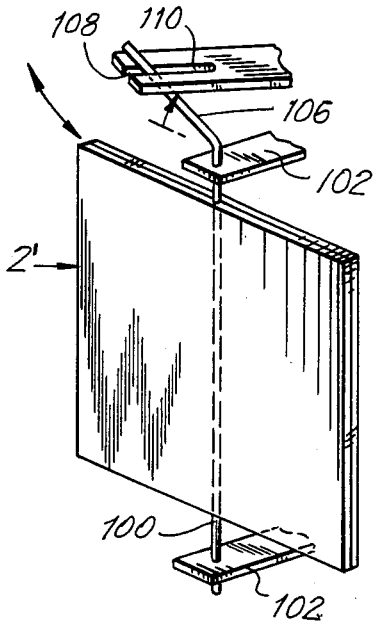
FIG. 11A
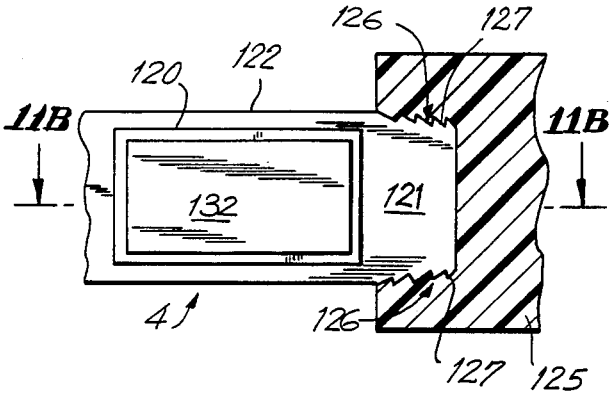
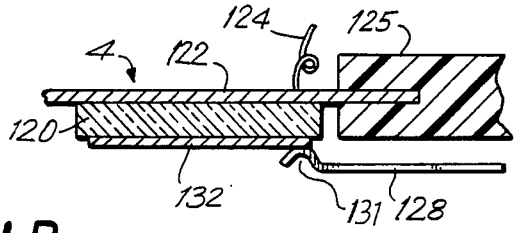
FIG. 11B
FIG. 14B
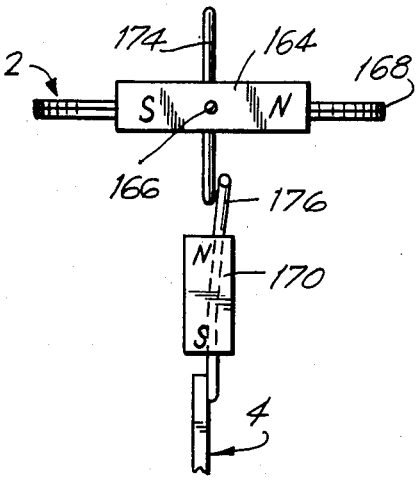
FIG. 14C
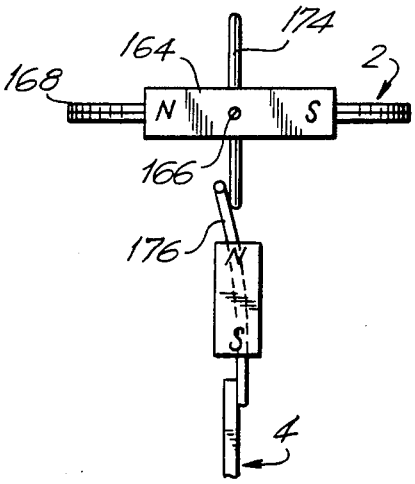

BI-STABLE DISPLAY DEVICE

BACKGROUND OF THE INVENTION

This invention relates to a display device for use in constructing bulletin boards and the like. More particularly, the invention relates to a display device in which the display element consists of a disc which has separate surfaces which are differently colored and which can be flipped about its supporting axis by remote control so as to display a surface having a selected color.

Remote control alphanumeric display devices are currently in use, for example, in bulletin boards at airports, in highway signs, and in bus signs where a multiplicity of discs are arranged in a plurality of rows, each disc being pivotably mounted so that one or the other of the contrastingly colored sides of each disc is exposed to view. By selecting the sides which are displayed, alphanumeric characters are formed which convey a message to the viewer. The discs may be circular, triangular, quadrilateral, or polygonal in shape.

In the known devices, a magnetically polarized element which forms part of a pivotable disc structure responds to the presence of the field of an electromagnet which has one magnetic polarity or the other to turn the disc to display one side or the other. The driven permanent magnet may be a polarized magnetic cylinder which is carried adjacent to the disc on the axis on which the disc rotates or it may consist of a permanent magnet which is sandwiched between the surfaces of the disc. In such devices, the development of sufficient motive power to turn an array of display discs about their respective axes requires a series of large electric pulses, using as much as three watts per pulse per coil. An array of such devices generates a substantial amount of heat and has a substantial weight which requires special support to withstand the shocks experienced, for example, in bus displays. Further, at least in versions of these structures having discs which are one-half inch in diameter and larger, the response of the display element is not as fast as would be liked for use in displays where rapidly moving images are to be produced. In versions using discs of less than one-half inch in diameter, activation of one disc can result in undesirable actuation of a neighboring disc.

SUMMARY OF THE INVENTION

The present invention provides an alphanumeric display device of the type generally described above in which a pivotable disc structure having at least two surfaces of different visual appearance is driven in rotation by means of a piezoelectric crystal drive. One end of the piezoelectric crystal drive is fixed, relative to the display. Motion of the free end of the drive in response to an applied voltage is coupled to the display to cause it to rotate to position one of the surfaces for viewing. In one embodiment of the invention, the display consists of a pair of discs which are mounted back-to-back to provide two exposed surfaces of contrasting colors, such as white and black. The back-to-back discs are fastened to a support member which is journalled in pivot points, providing an axis of rotation. The support member includes a drive point which lies off the axis of rotation. Motion of the free end of the crystal drive is coupled to the drivepoint for turning the display.

In a preferred embodiment, the display means consists of two discs which are laminated back-to-back on either side of a support shaft. Fastened perpendicular to the shaft, adjacent to the discs, is a drive arm which extends into the path of an actuator arm on the free end of the crystal drive. The crystal drive consists of a thin, flexible metal shim, one end of which is anchored in an insulating block and the other end of which is free, carrying the actuator arm. The piezoelectric crystal consists of a sheet of piezoelectric crystal material which is bonded to one face of the metal shim. A conducting surface is formed on the opposite face of the crystal. A DC drive voltage is applied between the metal shim and the conductive surface and the contraction or expansion of the piezoelectric crystal causes the crystal drive to be deflected out of the plane in which it lies when it is not electrically excited. The actuator arm on the free end of the shim strikes the cross arm and causes the disc to rotate rapidly on the support until the other end of the cross arm encounters the actuator arm. To retain the disc in either of its end positions, a permanent bar magnet which rotates with the disc has outward extremities positioned to encounter a stationary piece of ferromagnetic material. In other embodiments of the invention the driving force is coupled from the crystal drive via other over-the-center mechanical or magnetic linkages.

It is an object of the present invention to provide a display device for use in electric bulletin boards and signs which is light in weight and quick to respond to electrical signals.

It is another object of the present invention to provide a display device for use in remotely controlled bulletin boards and signs which is economical in the use of electric power.

It is a further object of the invention to provide a display device for use in remotely controlled bulletin boards and signs which is inexpensive.

It is still another object of the invention to provide a display device for use in remotely controlled bulletin boards and signs which is easily manufactured.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 1, 2, and 3 are perspective, end, and partial longitudinal sectional views, respectively, of a bi-stable display device using a piezoelectric crystal drive in accordance with the teachings of the invention;

FIG. 8 is a perspective view showing a modification of the structure of FIGS. 7A and 7B;

FIGS. 9A and 9B are perspective and plan views, respectively, of a disc driving mechanism in which the disc is displayed at an angle to the axis of the piezoelectric drive;

FIG. 10 is a perspective view of another arrangement of the disc driving mechanism of FIG. 9B;

FIGS. 11A and 11B are plan and elevational views of a mounting for the piezoelectric drive;

FIGS. 14B and 14C are plan views, of an arrangement in which magnetic elements are used in an over-the-center coupling arrangement in accordance with the invention;

DETAILED DESCRIPTION OF THE INVENTION

Figure 4:
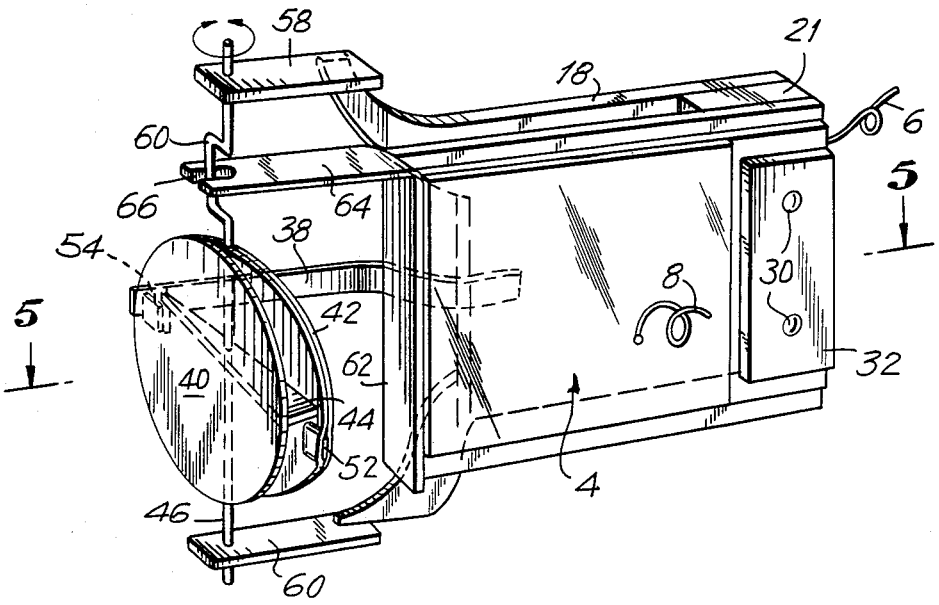
FIGS. 4 and 5 are perspective and sectional plan views, respectively, of a second illustrative embodiment of the invention.

Reference is first made to FIGS. 1, 2, and 3 where there is shown a first embodiment of a bi-stable display device in which a movable display element driven by a piezoelectric crystal in accordance with the teachings of the invention. The device has, as its reversible display element, a disc 2 which can be pivoted about its vertical axis by motion derived from the flexing of piezoelectric crystal drive 4 in response to the application of an electrical impulse to crystal drive leads 6 and 8. Display element 2 has diversely colored surfaces, such as black on one side and white or yellow on the other, and is conveniently formed of a pair of discs which are fastened together, back-to-back, on either side of support member 10. Small versions of display element 2, e.g., those having a circular or quadrangular form on the order of one-half inch across, can be made of conveniently available black and yellow tape with the adhesive sides of the tapes pressed together on either side of disc support 10. Support member 10 is bowed, with the bow lying in the plane of display element 2. As best seen in FIGS. 1 and 2, the shaft of disc support member 10 is pivoted near its upper and lower ends in horizontal frame extensions 12 and 14, respectively, being provided with a washer-like thrust disc 16 to prevent the disc support from slipping downwards. Frame extensions 12 and 14 are fastened to vertical frame plate 18.

Piezoelectric crystal 3 is bonded to crystal support shim 20 by means of conducting cement or the like (not shown), and, together with drive leads 6 and 8, and support shim 20, forms crystal drive 4. Support shim 20 is made of thin sheet metal, preferably having the same coefficient of expansion as piezoelectric crystal 3, such the nickel-iron alloy known by the trade name Kovar. Support shim 20 has, at its free end, a bent-over section 22 to which a forward-extending actuator rod 24 is secured. The forward end of actuator rod 24 has an axial slot 28 which loosely receives the upper portion of bowed disc support 10. A coil spring 26 is mounted around rod 24 and, bearing on bent-over section 22 of shim 20, presses against bowed disc support 10, on either side of slot 28, and provides an action like that of a toggle switch, which urges disc support 10 over the center line between the plane of crystal drive and the axis of rotation of disc support 10.

The assembly of piezoelectric crystal 3, crystal support shim 20, actuator rod 24 and coil spring 26 is supported on frame plate 18 by means of screws 30 which pass through insulator 32, crystal 3, shim 20, and insulating spacer 34, into tapped holes (not shown) in frame plate 18. Connecting lead 8 is fastened, by means of conducting cement or the like, to metallic crystal electrode 26 which is coated on the exposed surface of crystal 3 in a manner well known in the art. The second electrical connection to crystal 3 is made via connecting lead 6 which is fastened to shim 20. As best seen in FIGS. 1 and 3, a wedge-shaped stop 37 is supported from the frame by stop support 38, at one side of display disc 2, so as to limit rotation of the disc. If desired, to double the force delivered by crystal drive 4, a second crystal element and connecting electrode can be mounted on the reverse side of the shim and electrically driven at the same time as the first crystal.

Operation of the bi-stable, crystal-actuated display device of FIGS. 1 to 3 is as follows. Display element 2 is normally at rest in one of the two positions 2 and 2' shown in FIG. 3. The application of a positive or negative voltage, typically on the order of 50 to 90 volts, between connecting leads 6 and 8 causes piezoelectric crystal 3 to flex in one direction or the other, depending on the polarity of the voltage. For the sake of the present description, it will be assumed that the application of a positive potential to lead 6 causes crystal 3 to move actuator rod 24 upwards in the plane of the paper (FIG. 3), and that reversing the polarity causes actuator rod 24 to move downwards. It will also be assumed that the surface of display element 2 which faces out of the display device (in FIG. 3 in solid lines) is white and that the surface which faces inward is black. Thus, to place the display element in position 2' (shown in dashed lines) so that the black surface is presented to the viewer, a positive potential applied to lead 6 causes crystal 3 to expand along its length, causing the free end of crystal support shim 20 to be deflected upward (FIG. 3), thereby raising actuator rod 24.

Upward motion of rod 24 applies lateral pressure, via end slot 28, to bowed disc support 10. Since the pressure is applied at a drive point which lies off of the axis of rotation, disc support 10 is forced to turn in the pivots of frame extensions 12 and 14, and display element 2 rotated. When fully rotated, the rear surface of display element 2 comes to rest against the rear surface of stop 37 at position 2' where, because of the thickness of stop 37, the plane of the disc lies at an angle of 70° or less, relative to the axis of crystal drive 4, e.g. the angle of FIG. 3. To return disc 2 to its original position, the polarity of the voltage applied to the leads is reversed, making lead 8 positive. Crystal drive 4 now moves actuator rod 24 downward, turning bowed disc support 10 back over-the-center and placing it and disc 2 in the position shown in the solid lines. As stated above, coil spring 26 presses continuously against disc support 10 to insure the positioning of the disc against the stop at either end of its travel, thereby maintaining the selected surface in viewing position. Also, it has been found that, to insure response of disc support 10 to lateral pressure from actuator rod 24 and to maximize the amount of disc surface displayed, the included angle between the faces of disc stop 37 in either display position should be between approximately 140° and 120°.

In the above embodiment, if coil spring 26 is omitted, keeping a DC voltage on crystal 4 will maintain one side or the other of disc 2 exposed to view. If no voltage is applied, the crystal will return to its neutral, undeflected condition and disc 2 will be aligned with actuator rod 24. This arrangement of the display element, therefore, is useful in circumstances where light does not shine brightly onto the discs since it can provide a three color display in which the neutral, dead-center position is black, and in which the two faces of display element 2 have other colors.

Figure 5:
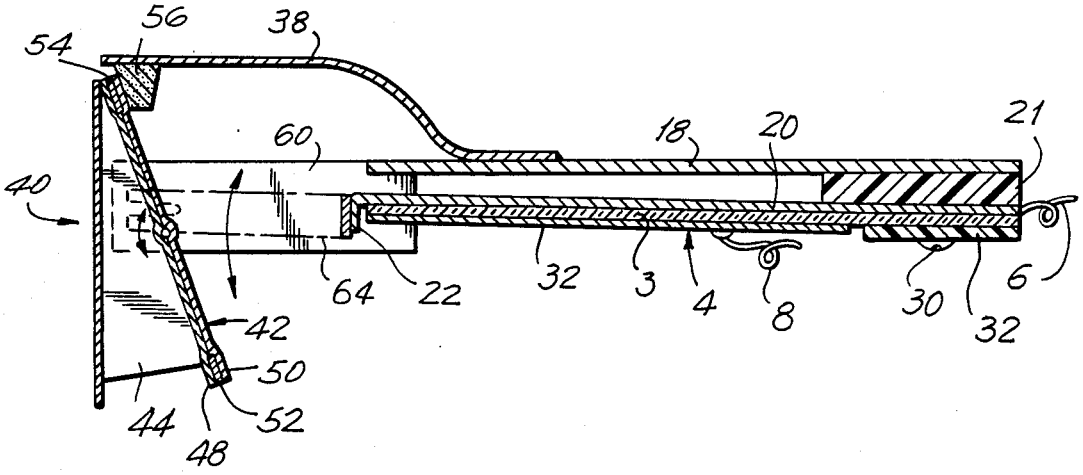

A second illustrative embodiment of the invention is shown in the perspective view of FIG. 4 and in the partial sectional plan view of FIG. 5. In these figures, and in the figures which follow, elements which are the same as those used in FIGS. 1 to 3 are given the same numbers.

In the embodiment of FIGS. 4 and 5, crystal drive 4 and frame 18 are supported in insulated relationship by means of insulators 21 and 32 which are held by screws 30 to frame 18. In this case, the display element itself has a wedge-shaped configuration so that, when it is at rest, light-reflecting surface 40 is positioned perpendicular to the axis of the display device to maximize the white aspect of the display, while the reverse, black surface 42 of display element 2, is positioned at an acute angle relative to white surface 40 by a triangular spreader 44. The rear portion of the display element, e.g., the part which carries black surface 42, is conveniently made of two discs 48, 50 which are conveniently laminated together with a vertical disc support shaft 46 in between. Ferro-magnetic latch elements 52 and 54 are mounted between discs 48 and 50, being held at the edges of the discs on a line which is perpendicular to disc support shaft 46. Disc support shaft 46 lies directly on the axis of rotation between the pivot points in frame extensions 58 and 60. As shown in FIG. 4, disc support 46 includes a U-shaped crank section 60 which provides an off-axis point for the application of turning force. Crank section 60 lies in the plane of laminated disc 48, 50 and is engaged by actuator arm 64. Actuator arm 64 is one leg of an L-shaped bracket 62 on the driven end of crystal drive 4. The tip of actuator arm 64 carries a slot 66 in which the vertical portion of crank 60 is received. Disc stop 56 is a wedge-shaped permanent magnet and holds whichever ferro-magnetic body 52 or 54 is last flipped into contact with it.

Operation of the embodiment of FIGS. 4 and 5 is the same as that of the first embodiment, in that an appropriately polarized voltage need be applied only momentarily in order to flip the display element from a given position to the other. The display element is then retained in position by magnetic attraction of the permanent magnet and the nearest ferromagnetic material.

The preceding embodiments of the invention employ different mechanical arrangements by means of which a small movement of a flexible, cantilevered shim which is driven by an electrically-excited piezoelectric crystal is mechanically amplified to produce a substantial change in position of a display element. Other linkages which can also be used for this purpose are described below. All of these structures are characterized by lightness in weight, simplicity of structure, and economic use of material. To simplify explanation, some of the actuating structures are shown without disc stops, pivots, or thrust bearings. it will be understood by those skilled in the art that these elements are to be appropriately placed to provide end positions and the necessary rotational support for the movable display element.

Figure 6A:
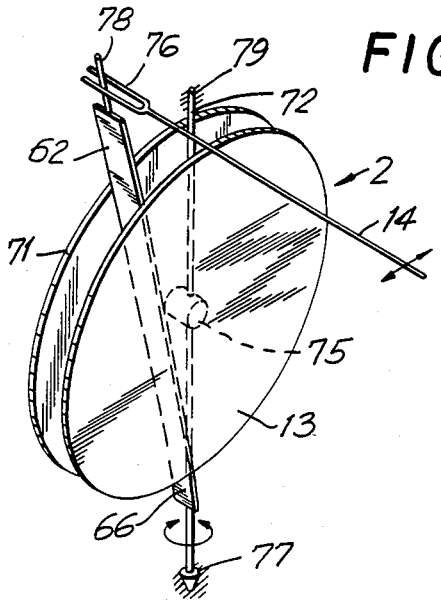
FIGS. 6A and 6B are perspective views of two bi-stable, over-the-center mechanisms which are useful in constructing display devices in accordance with the invention.
Figure 6B:
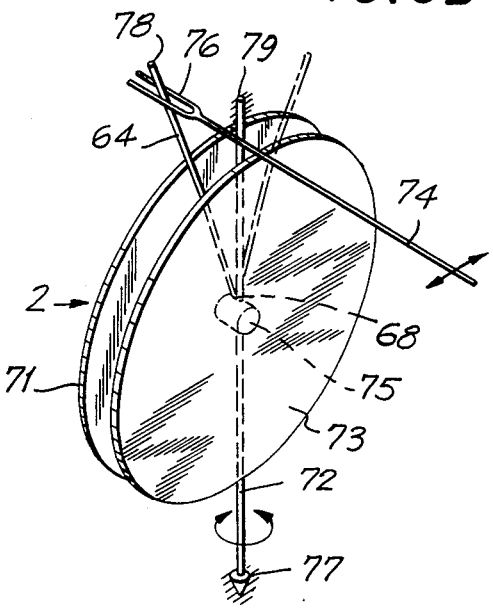

The display disc and display disc-driving arrangements shown in FIGS. 6A and 6B each utilize a display element which consists of two discs 71 and 73 which are positioned in parallel, spaced-apart relationship on a center post 75. Straight support shaft 72 passes through center post 75, being pivoted at its lower end in thrust bearing 77 and at its upper end in pivot 79. Support shaft 72 lies in the mounting plane of a crystal drive 4 (not shown). The disc structures of FIGS. 6A and 6B are each caused to rotate on their respective shafts by lateral movement transmitted to an actuator rod 74 by the crystal drive. The lateral movement is coupled by means of a fork 76 on the end of actuator rod 74, to the free, uppermost end of the respective, pre-stressed, resilient member. In the case of FIG. 6A, the pre-stressed, resilient member is denoted 62, and, in the case of FIG. 6B, the resilient member is denoted 64. Both resilient member 62 and resilient member 64 are pre-stressed in the sense that they are bent or otherwise shaped to naturally assume the curved shape of the drawings. Thus, when pressed toward support shaft 72 by rightward movement of a fork 76 in response to movement of a crystal drive, each of these flexible members reacts by moving towards and into the fork and display element 2 rotates about its support shaft, turning the discs. The application of pressure results in the passage of each flexible member 62 or 64 in front of its support rod 72, and causes rotation of the display discs to the opposite, resting position (not shown).

By comparing the structures of FIGS. 6A and 6B, it can be seen that resilient member 62 of FIG. 6A is made up of a flexible, springy strip which has its nether end fastened to a low point on support rod 72 by, for example, spot welding. The strip passes between display discs 71 and 73 and emerges at the upper edges of the discs in the form of a rod-like extension 78 which is engaged in actuator fork 76. Resilient member 64, on the other hand, may simply consist of a stiff wire which has its lower end fastened to center post 75 or at another suitable point on support rod 79. Lying in a plane parallel to the disc faces which includes support rod 72, resilient member 64 extends away from support rod 72 and upwards beyond the discs to extension 78 to be loosely received in actuator fork 76. As with preceding embodiments of the invention, stops may be employed to limit travel of display element 2 to angles of between 60° and 70° on either side of the center line between the crystal drive and the axis of rotation of the display so as to insure that the vector of force applied by actuator fork 76 lies a sufficient distance off of the axis of rotation to drive the display in rotation.

Figure 7A:
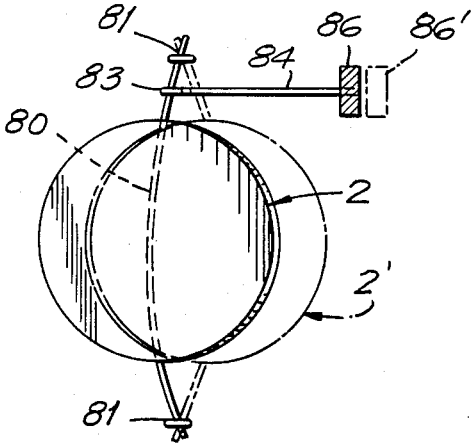
FIGS. 7A and 7B are elevational and plan views of another over-the-center coupling for driving display devices according to the teachings of the invention.
Figure 7B:
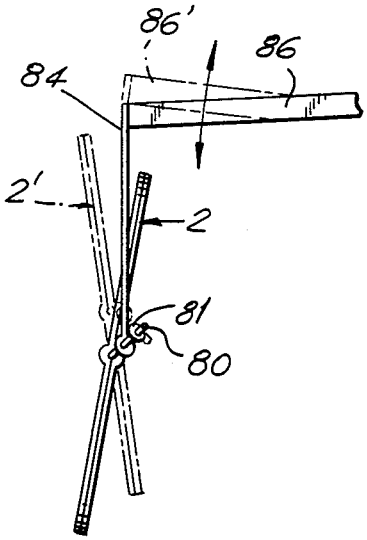

FIGS. 7A and 7B illustrate an arrangement in which the disc support shaft 80 has a straight portion which is fastened between the laminations of disc 2. On either side of the disc, support shaft 80 is bent at an angle to the straight portion, the angle being as much as thirty degrees. As shown in FIG. 7A, the upper and lower ends of support shaft 80 are each pivoted in pivots 81 at a distance from the upper and lower edges of the disc. The result is support for the disc off of the axis of rotation. The drive point for an actuator eyelet 83 is placed close to the edge of the disc. Actuator eyelet 83 is carried on the free end of an actuator arm extension 84. The latter consists of a flexible, but axially rigid, wire or rod which is fastened laterally to the end of actuator arm 86 on the crystal drive unit (not shown) and serves to couple displacement of the crystal drive into turning force while flexing to accommodate changing spacings between the coupled parts.

The embodiment of FIG. 8 is a variation of FIGS. 7A and 7B in which the linkage between eyelet 83 and crystal-driven actuator arm 86 is provided by a coil spring actuator arm extension 88. The coil spring extension 88 may be an elbow or it may have one or more resilient turns as illustrated. Coil spring extension arm 88 functions as a low cost hinge, providing compliance needed to accommodate the changing distances between the coupled parts as they move. The elbow portion of actuator arm spring extension 88 may take other forms, such as a right-angle bend in a piece of piano wire, etc.

FIG. 9A is a perspective view of a structure in which a display element disc 2 is driven by a crank 98 which is formed in support shaft 96 and which lies in the plane of the disc. Crank 98 is contained in the angled slot 94 of actuator arm 90. Angled actuator arm 90 is relatively short and is directly fastened to crystal drive 4. The angulation provided by slot 94 in the structure of FIG. 9A provides considerable latitude in crystal placement relative to the disc and its support structure. As shown in FIG. 9A, crystal drive 94 is at an angle of 45°, relative to the display positions of display element 2. By also using the offset crank 98' of FIG. 9B which is at an angle of 45° relative to the plane of display disc 2, the crystal drive element may be oriented parallel to the plane of the display. FIG. 9A thus illustrates the use of an offset slot or an offset crank or a combination of both, with a piezoelectric drive of the invention, to deliver force to an off-axis point in the plane of rotation of a display device.

FIG. 10 illustrates another arrangement for delivering force to a point on the support shaft of a display device which is offset from the axis of support of the display device. Here an axial disc support shaft 100 pivots in upper and lower stationary supports 102 which are located close on the support shaft to display element disc 2. The end of support shaft 100 above upper stationary support 102 is bent sideways to provide an angled portion 106. Angled portion 106 is movably contained in end slot 108 of actuator arm 110 at a point sufficiently removed from stationary support 102 to provide the necessary off-axis drive point. Actuator arm 110 is moved by a crystal drive as previously described. Display element 2', in this embodiment, is made of rectangular shapes of different colors which are laminated back to back.

FIG. 11A and 11B show the manner in which a crystal drive 4, consisting of piezoelectric crystal 120, flexible shim 122, and crystal surface electrode 132 are supported in a plastic mounting block 125. To this end, the near end of flexible shim 122, that is the end which is received in plastic mounting block 125, is tapered, providing a tongue-like projection 121 which extends beyond the end of crystal 120. The lateral edges 26 of tongue 121 are provided with serrations or teeth 127. The tapered end of crystal drive shim 122 is forcibly inserted into a mating, tapered slot 126 mounting block 125. Thus, when crystal drive shim 122 is placed in position, serrated teeth of tongue 124 engage and are wedged into the plastic of mounting block 125 on either side of the slot.

Connections to crystal drive 4 in mounting block 125 are made by means of a contact arm 128 which, like mounting block 125, is supported from the frame by structural means which are not illustrated. Contact arm 123 is a resilient rod or wire which is disposed, so that, when crystal drive 4 is pushed into place in slot 126, rounded contact portion 131 frictionally engages the exposed surface of crystal surface electrode 132. A second connection is made by means of a pigtail 124 which is conveniently fastened to flexible shim 122 as shown in FIG. 11B.

Figure 12:
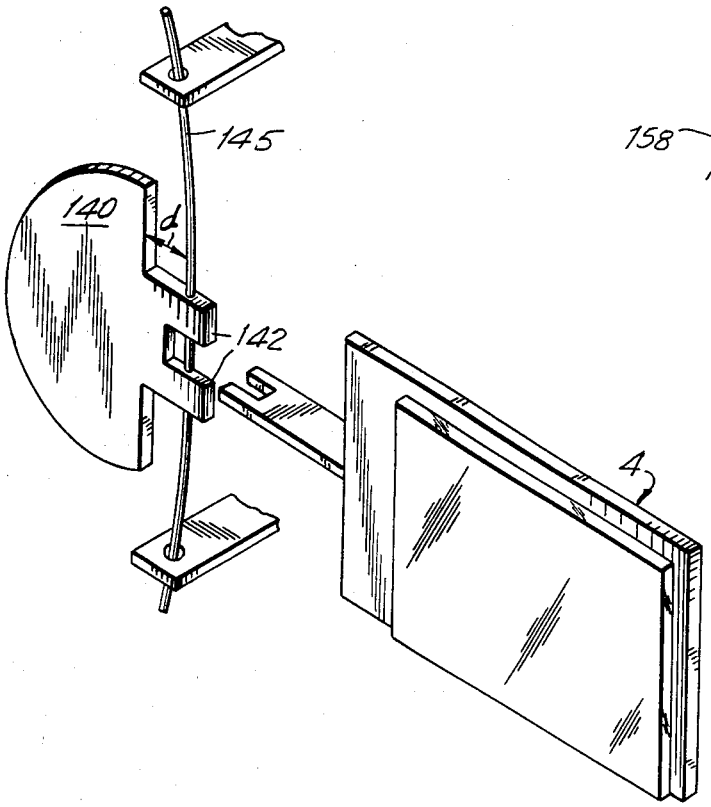
FIG. 12 is a perspective view of a display element in the form of a half disc.
Figure 13:
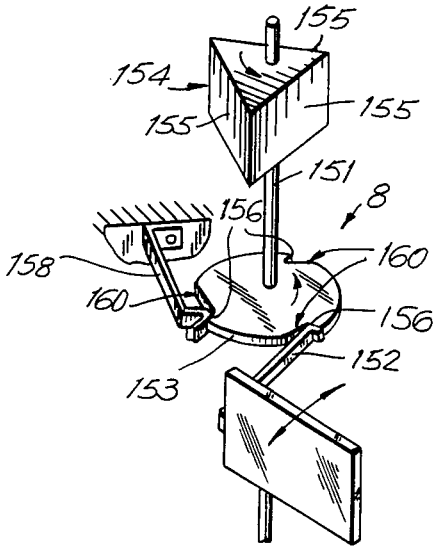
FIG. 13 is a perspective view of an embodiment of the invention in which the display element has multiple display faces.

FIGS. 12 and 13 illustrate display devices in which display elements other than circular discs are used. In FIG. 12, semicircular disc 140 is supported on a bowed disc support shaft 145 by means of co-planar laterally projecting tongues 142. The off-axis distance between the pivot points of shaft 145 and the half-diameter of the disc to which tongues 142 are attached is such that the half-diameter of the disc is on the axis of rotation. This structure can be driven by an actuator arm carried on crystal driver 4 in the same manner as previous embodiments of the invention.

In the embodiment of FIG. 13, crystal driver 4, consisting of a crystal element, support shim, and crystal surface contact electrode, as previously described, drives, by means of transverse actuator arm 152, a rotary cam 153 carried on a shaft 151. A display element block 154 having three display surfaces 155 is mounted on shaft 151 for rotation therewith. Rotary cam 152 has, spaced around its periphery, three radially-projecting cam surfaces 156 which can be successively engaged by the end of actuator arm 152, each cam surface corresponding to one of the three display surfaces. Repeated application of voltage to crystal drive 4 causes actuator arm 152 to push against the cam surface against which it currently is at rest, thereby turning the block to bring a new surface into display position. Resilient detent arm 158 successively engages notches 160 in cam 153 to insure positioning of the selected surface of display element block 154 at the desired viewing angle. The surface of each of the three faces of block 154 may be of a different color, permitting the construction of multicolored displays.

In operation, the application of a voltage of one polarity, causes crystal drive unit 150 to retract transverse actuator arm 152, causing it to engage the next radial surface 156 on the periphery of cam 153. Crystal drive unit 150 is then driven in the opposite direction by the application of voltage of the opposite polarity so as to move the next colored surface on block 154 into viewing position. This structure may also be driven by two crystal driver units, each of which is driven in succession to act over a lesser arc of cam surface, e.g., sixty degrees, permitting the use of crystal drivers having smaller strokes. In still other arrangements, display element block 154 may be cubic or have some other polygonal shape.

In the embodiments of FIGS. 1–3 and 4–5, mechanical coupling was used in which an off-axis, over-the-center force vector was used to reverse the position of the display element. In one case, the disc was held at the end of its rotation by means of a stop, with force for holding the disc on the stop being supplied by the piezoelectric crystal drive or by the action of a spring. In another case, a permanent magnet served as the stop and small pieces of ferro-magnetic material at the outermost edges of the disc were magnetically attracted to the magnet to latch the disc at either end of its travel. The embodiments of FIGS. 14 and 15 show arrangements in which magnets are used for positioning of the disc and, together with appropriately placed stops, provide a latching action.

Figure 14A:
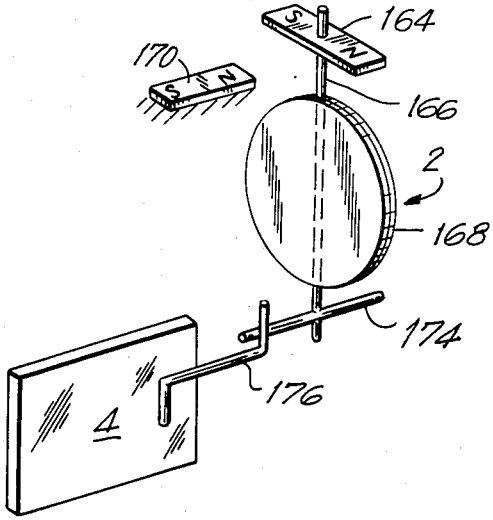
FIGS. 14A is a perspective view.

In FIGS. 14A, 14B, and 14C, display element disc 168 is carried on a vertically-oriented straight support shaft 162 which is journaled, as in previous embodiments, in frame extensions (not shown). As shown in FIG. 14A, a moving magnet 164 is carried on support shaft 166 of disc 168, lying in the plane of, and rotating with, the disc. Stationary magnet 170 is fixed in the plane of rotation of moving magnet 164 on a support (not shown) which is fastened to the frame of the display device. As illustrated, the North end of stationary magnet 170 lies nearest to shaft 166. Since the two magnets lie in the same plane, the North end of moving magnet 164 can move past the North end of fixed magnet 170 when display is turned. As may be visualized with the aid of FIGS. 14B and 14C, if the North end of moving magnet 164 is brought into alignment with the North end of fixed magnet 170 and released, it will naturally tend to move away from the North end of fixed magnet 170, being driven by the repulsion of the like, North poles of the magnets. Rotation of the display element is stopped when drive arm 174 on support shaft 166 encounters the distal end of actuator rod 176. The disc can thus be pushed into either of two display positions and held there by the magnetic force.

The disc can be spun to one side or the other by striking disc drive arm 174 by means of actuator arm 176. Disk drive arm 174 is mounted on support shaft 166 perpendicular to the planes of display disc 168 and moving toggle magnet 164. To this end, crystal drive 4 is moved by the application of voltage and actuator arm 176 is caused to strike disc drive arm 174, flipping disc 168 and moving magnet 164. Once the North end of movable magnet 164 has passed the North end of stationary magnet 170, e.g. dead center, display element disc 168 continues to move towards its new end position, driven by the added force of the magnets. Rotation of the disc stops when the disc is once more in display position, since disc drive arm 174 is now in contact with the other side of crystal-driven actuator arm 176.

Figure 15:
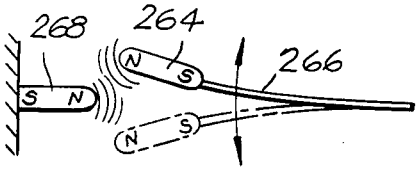
FIG. 15 is an alternative magnetic over-the-center coupling arrangement.

In the magnetic latch of FIG. 15, a movable permanent magnet 264 is attached to one end of a resilient support arm 266, the other end of which extends from a crystal drive (not shown), and may be formed, for example, as an extension of the flexible shim which supports the drive crystal. One pole of the magnet 264, illustrated as the North end, is exposed at the free end of the movable toggle element thus formed. A stationary magnet 268 is fastened to the frame of the display device so as to have its North end positioned adjacent to the path of the North end of movable magnet 264. When flexible actuator support arm 266 is moved towards the centerline connecting the fixed magnet and the crystal drive, magnetic repulsion between the ends of stationary magnet 268 and movable magnet 264 increases and if the moving force is released, it takes control to move resilient arm 266 quickly away from dead center until the resistance afforded by the resilient arm equals the force of repulsion, and the movement is stopped. If the moving magnet moves past dead center, it travels on until stopped by the resistance of the drive and resilient arm. This arrangement can be used in the structure of FIGS. 4 and 5, instead of the magnetic stops, by attaching resilient arm 266 to the crystal drive and by supporting stationary magnet 268 at a suitable position on the frame.

Figure 16B:
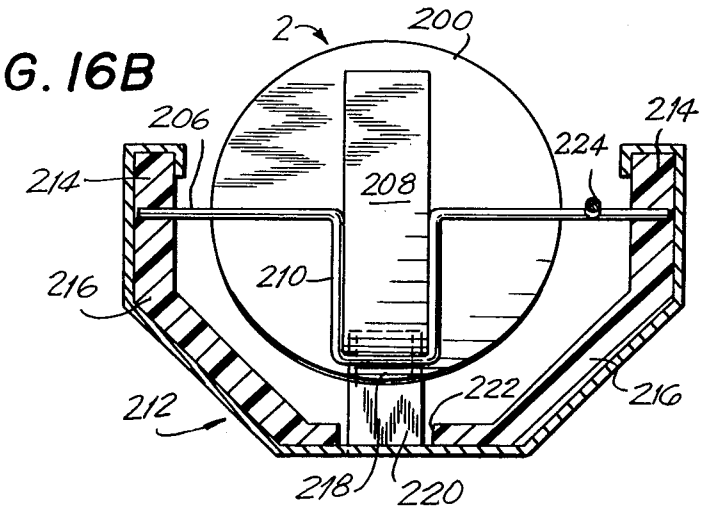
FIGS. 16A, and 16B and 16C are perspective, and sectional elevation views, respectively, of a preferred embodiment of a display device constructed in accordance with the invention.
Figure 16A:
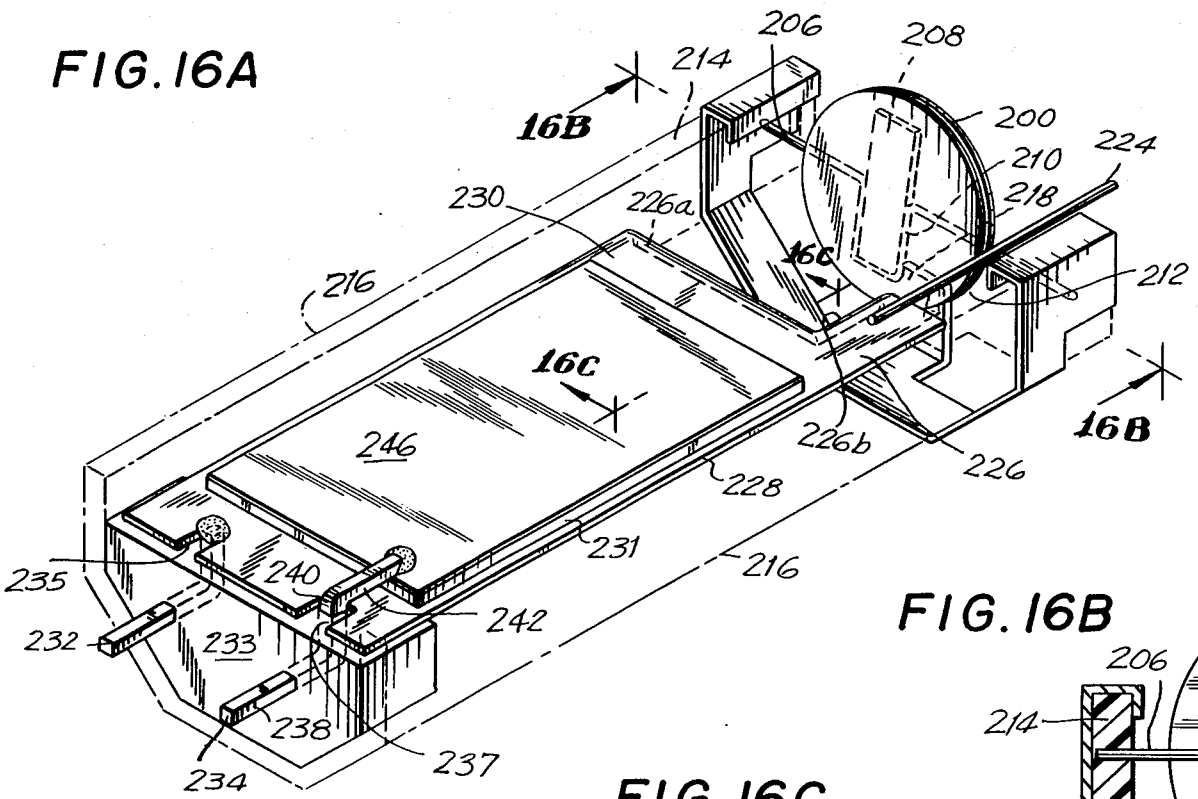
Figure 16C:
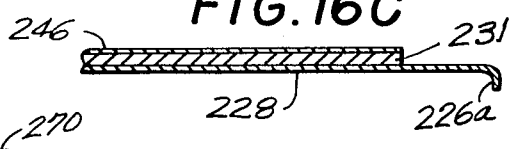

FIGS. 16A, B and C illustrate a preferred embodiment of the invention. In this embodiment, which is designed for stacking in an array, a display element disc 200 has, laminated between its opposing light and dark faces, a disc support shaft 206. Support shaft 206 is provided with a central, U-shaped portion 210 within which one end of a bar magnet 208 is positioned so as to be balanced on either side of the support shaft. The ends of the disc support shaft 206 are journalled in two side walls 214 of display device chassis 216 (shown in dashed lines in FIG. 16A). A disc stop 218, formed as a trapezoidal wedge of ferro-magnetic material, is held beneath disc 200 by support arm 220 (FIG. 16B) so as to lie in the path of either end of bar magnet 208 as it rotates with disc 200. A frame 212 which extends around the body of chassis 216, serves to position stop support arm 220 upward through cutout 222 in the plastic of which chassis 216 is made. Display element disc 200 is rotated by movement imparted to a drive arm 224 by an actuator arm 226. Light in weight, drive arm 224 is a stiff wire or rod which is fastened to disc support shaft 206, being mounted substantially perpendicular to the plane of disc 200. Actuator arm 226 is a tab-like extension of crystal drive shim 228, being strenthened by bent-over portions **226*a* and 226*b* (FIGS. 16A and 16C). Bent-over reinforcing edges 226*a* and 226*b* are die-formed on shim 228 at the same time, being joined together in the angle between the distal edge of shim 228 and the contiguous lateral edge of actuator arm 226**.

As in the preceding embodiments, piezoelectric crystal 231 is cemented to drive shim 228 and actuator arm 226 is moved upward when voltage of one polarity is applied to piezoelectric crystal 231 via connecting leads 232 and 238, and downward by the application of voltage of the opposite polarity. Connecting lead 232 is an L-shaped conductor which is molded into insulating support block 233 which, in turn, is fastened in one end of chassis 216. Connecting lead 232 is L-shaped, having its longer leg lying parallel to the plane of the crystal drive and its shorter leg lying transverse thereto and extending upward into engagement with slot 235 in the fixed end of support shim 228 where it is conductively fastened, for example, by low temperature solder. Similarly, a second connector 238 which has an L-shaped portion comprising a long leg 238 and a short leg 240, is also molded into support block 233. Short portion 240 extends through a second slot 237 in the fixed end of shim 238 without contacting the shim. A third leg 242 extends from the short portion 240 forwards and over piezoelectric crystal 231 where it is soldered to crystal contact electrode 246.

In operation, voltage of one polarity or the other is briefly applied between crystal connecting leads 232 and 238, causing actuator arm 226 to strike drive arm 224 and to flip disc 200. When disc 200 has spun to the end of its travel and comes up against stop 218, magnetic attraction between permanent magnet 208 in the disc and the ferro-magnetic material of stop 218 retains the disc in display position. When drive arm 224 is hit by a reverse stroke of actuator arm 226, disc 200 is flipped to the other display position. This structure has the advantages of having small moving masses, components which are easy to fabricate, and of providing a substantially full 180° reversal of the display element.

Figure 17:
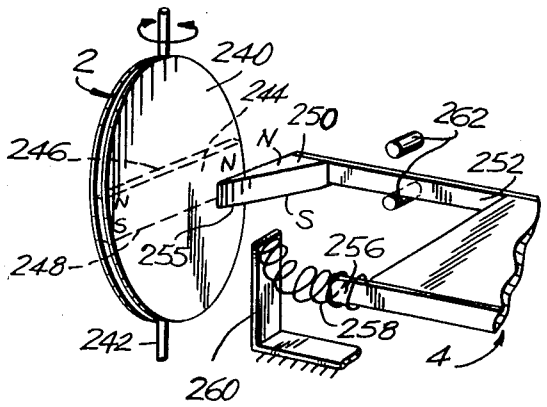
FIG. 17 is a partial perspective view of still another over-the-center arrangement using magnetic coupling.

FIG. 17 illustrates an embodiment of the invention in which magnetic force is used for driving and holding the display element. Here, a display disc 240 contains, laminated transversely of vertical disc support shaft 242, an elongate display disc bar magnet 244. The upper edge 246 of bar magnet 244 is polarized North and the lower edge 248 is polarized South. Similarly, the upper edge 253 of actuator bar magnet 250 is polarized North, and the lower edge 255 is polarized South. Actuator bar magnet 250 is shown in its lower position, e.g., positioned adjacent to the South-polarized lower edge 248 of disc bar magnet 244. Disc 240 is therefore held against rotation by magnetic attraction between the bottom surface of display disc bar magnet 244 and the top surface of actuator bar magnet 250. Actuator bar magnet 250 is carried on an actuator arm 252 which projects towards disc 240 from the free end of crystal drive 4. The end of crystal drive 4 also carries a short toggle arm 256 which lies parallel to actuator arm 252 and which is engaged in one end of toggle spring 258. The other end of toggle spring 258 is fastened to a toggle spring support 260 which is fixed to the frame (not shown) of the display device.

As shown in FIG. 17, crystal drive 254 is in its downward position, toggle arm 256 having carried the inner end of toggle spring 258 below center. Actuator arm 252 and actuator magnet 250 are also positioned at the lower end of their travel. The application of voltage to piezoelectric drive 254 raises actuator rod 252 and actuator magnet 250. As actuator magnet 250 is lifted, its North and South polarized edges 253 and 255, respectively, move into alignment with the North and South polarized edges 246 and 248 of disc magnet 244, and the force of magnetic repulsion between the like magnetic fields causes the end of disc magnet 244 to spin disc 240 away. Meanwhile, actuator magnet 250 continues its upward travel and, by the time that the oncoming end of disc magnet 244 approaches, the South-polarized lower edge 255 of actuator magnet 250 is at the level of the North-polarized upper edge 246 of disc magnet 244, where magnetic attraction again holds the two magnets together. At the same time, toggle arm 256 has passed upwards over dead center and is now at its upper position. The force of spring 258 is added to that of the magnets to hold crystal drive 4 in the raised position. To return disc 240 to its original position, voltage of reversed polarity is applied to crystal drive 4, forcing it downward to restore disc 240 to the position from which it started. Stops 262 are positioned above and below actuator arm 252 to prevent over-travel of magnet 250 under the influence of toggle spring 258. It is to be understood, however, that given a balance in the structures and in the dynamics of the system such that the attractive force between disc magnet 244 and actuator magnet 250 at the end of travel is substantially equal to the residual force in toggle spring 258, stops 262 can be eliminated. Note, also, that the over-the-center magnetic toggles of FIGS. 14 and 15 can be used instead of toggle 256, 258, and 260 of FIG. 17, if desired.

Figure 18:
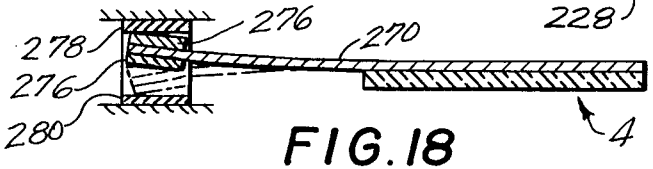
FIG. 18 is a sectional view of a magnetic latch which may be used in display devices of the invention.

In some cases, it may be desirable to utilize a magnetic latch like that shown in FIG. 18, instead of, for example, the magnetic stop of FIGS. 4, 5 or the mechanical toggle arrangement of FIG. 17. In the structure of FIG. 18, magnetic attraction is utilized to immobilize a moving part of the drive when it has reached either of the desired end positions. In the structure of FIG. 5 magnetic attraction has been used to hold a display element 2 in place for viewing. In the structure of FIG. 18, magnetic elements are used to hold the piezoelectric crystal drive 4 at either end of its travel. Thus, a permanent bar magnet 276 is carried on the free end of a latch arm 270 which extends from crystal drive 4 and is attracted to one of two ferro-magnetic latch members 278 or 280 at either extreme of movement of the drive. Latch members 278 and 280 are supported on the frame (not shown) of the display device. In the present arrangement, latch elements 278 and 280 may, of course, themselves be permanent magnets and latch member 276 may then simply be made of ferro-magnetic material.

While the invention has been described above in detail in connection with a number of illustrative embodiments, it will be apparent to those skilled in the art that it is susceptible of further variation. For example, while the crystal drive has been illustrated as a cantilevered structure driven by a single crystal, the principles of the invention can be equally well applied to bimorphic piezoelectric drives and to drives which have two fixed ends and an intermediate moving point from which the drive motion is derived.

It will thus be seen that the objects set forth above, among those made apparent from the preceding description, are efficiently attained and, since certain changes may be made in the above article without departing from the spirit and scope of the invention, it is intended that all matter contained in the above description ahd shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A display device comprising:
   display means having at least two surfaces of different visual appearance;
   piezoelectric crystal drive means having at least one end fixed relative to the display means, the crystal drive means having a region which can be displaced in response to an applied voltage; and
   coupling means for converting displacement of the drive means in the rotation of the display means so as to position one of the surfaces for viewing.

2. A display device in accordance with claim 1, wherein the display means comprises a pair of back-to-back discs, each disc comprising a surface of different visual appearance.

3. A display device in accordance with claim 2, wherein one of the surfaces is light in color and the other surface is dark.

4. A display device in accordance with claim 2, wherein the surfaces are of different colors.

5. A display device in accordance with claim 1 in which the coupling means further comprises:
   support means on which the display means is carried, the support means defining an axis of rotation on which the display means is rotatable, the support means including a drive point lying off of the axis of rotation to which motion of the drive means is transmitted for rotating the display means.

6. A display device in accordance with claim 5, wherein the coupling means further comprises:
   actuator means comprising an arm fixed to the crystal drive means for displacement thereby, the arm including a slot in which the drive point of the support means is movable.

7. A display device in accordance with claim 6 and further comprising:

resilient means acting between the crystal drive means and the drive point of the support means for urging the drive point away from the drive means on either side of the center of the path of the drive point.

8. A display device in accordance with claim 7, wherein the resilient means comprises a coil spring carried on the arm of the actuator means.

9. A display device in accordance with claim 1 and further comprising:

stop means supported in fixed relation to the display means for limiting rotation thereof.

10. A display device in accordance with claim 5 and further comprising:

stop means supported in fixed relation to the display means for limiting rotation thereof.

11. A display device in accordance with claim 5, wherein the support means comprises a member having a central portion which is displaced from the axis of rotation, the display device and the drive point being located on the central portion.

12. A display device in accordance with claim 11, wherein the central portion comprises a bowed member.

13. A display device in accordance with claim 11, wherein the support means lies in a plane which is perpendicular to the plane of the display device.

14. A display device in accordance with claim 12, wherein the bowed member lies in the plane of the display device.

15. A display device in accordance with claim 5, wherein the support means comprises a shaft having a crank which serves as the drive point to which the drive means is coupled.

16. A display device in accordance with claim 5, wherein the coupling means further comprises:

a hinge-like resilient member having one end connected to the free end of the crystal drive means and the other end connected at an angle to the drive point on the support means, the resilient member flexing to accommodate differences in movement of the drive means relative to the drive point.

17. A display device in accordance with claim 16, in which the hinge-like resilient member comprises at least one turn of a coil spring.

18. A display device in accordance with claim 5, wherein the display means comprises a semicircular disc having a straight edge and back-to-back surfaces of distinct visual appearance and further comprising:

a tongue coupling the straight edge of the disc to the support means, the tongue lying in the plane of the disc.

19. A display device in accordance with claim 5 and further comprising:

an arm for coupling displacement of the drive means to the drive point, the arm being fastened to the drive means and extending laterally thereof, the arm being flexible to accommodate relative changes in position of the drive point and the free end of the drive means.

20. A display device in accordance with claim 6, wherein the slot in the arm on the crystal drive means lies at an angle relative to the plane of the crystal drive means.

21. A display device in accordance with claim 5 in which the display means comprises first and second adjacent outward-facing surfaces which are spaced apart from each other at an acute angle and in which the axis of rotation lies substantially at the second surface, and further comprising:

stop means for limiting rotation of the display means, the stop means positioning the first surface for display.

22. A display device in accordance with claim 21, in which the first outward-facing surface is light in color.

23. The display device of claim 21 in which the stop means comprises a permanent magnet and further comprising:

ferromagnetic latch elements mounted at the lateral extremes of the second surface for engaging the permanent magnet.

24. The display device of claim 21 in which the stop means comprises a ferromagnetic material and further comprising:

a permanent magnet mounted at the lateral extreme of the second surface for engaging the ferromagnetic stop means.

25. A display device in accordance with claim 5 in which the support means comprises a support member lying between pivot points on the axis of rotation, the support means further comprising an extension lying outside of one of the pivot points, the drive point being on the extension.

26. A display device in accordance with claim 1, wherein the crystal drive means comprises a flexible shim to which a sheet of piezoelectric signal material is fastened, one end of the shim having a serrated, tapered tongue, and further comprising:

mount means for supporting the crystal drive means in fixed position relative to the display means, the mount means comprising an insulating body having a slot in which the tongue of the flexible shim is received, the slot being dimensioned so that, when the tongue of the shim is forcibly inserted therein, the insulating body is engaged by the serrations.

27. A display device in accordance with claim 1 in which the crystal drive means comprises one fixed end, and further comprising:

mount means for supporting the crystal drive means in fixed position relative to the display means, the mount means comprising an insulating block to which the fixed end of the shim is anchored.

28. A display device in accordance with claim 1 in which the display means comprises back-to-back discs and in which the coupling means further comprises:

support means on which the display means is carried, the support means defining an axis of rotation of the discs;

a drive arm on the support means, the drive arm being perpendicular to the plane of the discs; and an actuator arm fixed to the crystal drive means, the actuator arm positioned to strike the drive arm at a drive point off of the axis of rotation when the crystal drive means is activated, whereby the discs are caused to rotate.

29. A display device in accordance with claim 28, wherein the drive arm extends away from the axis of rotation in opposite directions to provide a drive point on each side of the discs so that the discs can be caused to rotate in either direction.

30. A display device in accordance with claim 29, and further comprising:

means for maintaining one or the other drive point in contact with the drive arm to maintain a disc surface in display position.

31. A display device in accordance with claim 30, wherein the means for maintaining either drive point in contact with the drive arm comprises:

permanent magnet means fastened to the support means so as to rotate with the discs, a pole of the permanent magnet means moving along an arcuate path;

stationary permanent magnet means positioned adjacent to the arcuate path, the pole of the stationary magnet means which lies to the arcuate path being of the same polarity as the pole of the rotary magnet which moves along the arcuate path and being positioned so that, when rotation of the discs is stopped by contact of the drive arm against the actuator arm, the discs are maintained at that position by magnetic repulsion between the like poles of the magnets.

32. A display device in accordance with claim 28, wherein the actuator arm comprises an L-shaped extension of the crystal drive means, one leg of the extension being oriented transversely to the drive arm.

33. A display device in accordance with claim 28, in which the support means extends on either side of the discs and is oriented substantially parallel to the plane of the crystal drive means, and further comprising:

permanent magnet means fastened to the support means so as to rotate with the discs, the permanent magnet means being oriented transversely to the axis of rotation; and ferromagnetic stop means fixedly supported adjacent to the path of rotation of the permanent magnet means to attract the permanent magnet means to hold a surface of the disc in viewing position.

34. A disc drive in accordance with claim 1 in which the crystal drive further comprises:

a flat, flexible shim having one end fastened to a block of insulating material;

a flat body of piezoelectric crystal material bonded to the surface of the shim, there being a first conducting electrode surface therebetween;

a second conducting electrode surface on the other surface of the piezoelectric crystal;

first conductor means connected to the first conducting surface; and second conductor means connected to the second conducting electrode surface.

35. A display device in accordance with claim 1, in which the crystal drive means comprises a fixed end and a free end and further comprising:

magnetic toggle means coupled to the free end of the crystal drive means for retaining the drive means in a fixed position after displacement.

36. A display device in accordance with claim 35, wherein the magnetic toggle means comprises:

an elongate flexible member fastened to the free end of the crystal drive means;

permanent magnet means fastened to the free end of the flexible member for movement by the crystal drive means; and permanent magnet means supported in fixed relationship to the path of the moving magnet, both magnet means being oriented so that like poles of each magnet travel closest to each other, whereby magnetic repulsion between the like poles of the magnets forces the moving magnet means away from the fixed magnet means on either side of their nearest point of approach.

37. A display device in accordance with claim 1, wherein the crystal drive comprises a fixed end and a free end and wherein electrical actuation of the crystal drive means with voltage of one polarity displaces the free end thereof to a first position and reversal of the polarity displaces the free end to a second position, and further comprising:

magnetic latch means for holding the crystal drive means in either of the positions.

38. A display device in accordance with claim 37, wherein the magnetic latch means comprises:

permanent magnet means fastened to the free end of the crystal drive means; and ferromagnetic stop means positioned at each extreme of movement of the free end of the crystal drive means, the free end of the crystal drive means at either end position by magnetic attraction.

39. A display device in accordance with claim 37, wherein the magnetic latch means comprises:

permanent magnet stop means positioned adjacent to each end of the path of the free end of the crystal drive means; and ferromagnetic means coupled to the free end of the crystal drive means, the ferromagnetic means being magnetically attracted to the stop means to hold the crystal drive means in viewing position.

40. A display device in accordance with claim 5 and further comprising:

stop means supported in fixed relation to the display means for limiting rotation thereof to an angle of less than approximately 70° on either side of the line between the crystal drive means and the axis of rotation of the display means.

41. A display device in accordance with claim 5 in which the display means comprises a pair of spaced-apart, parallel discs, and in which the support means further comprises:

spacer means for maintaining the discs in parallel, spaced-apart relation; and resilient linking means having one end coupled to the support means on the axis of rotation, the resilient linking means formed in an arc and lying between the discs in a plane which includes the axis of rotation, the linking means extending beyond the discs to provide the drive point to which the crystal drive means is coupled.

42. A display device in accordance with claim 41 in which the support means comprises a shaft lying on the axis of rotation to which the spacing means is attached and in which the resilient linking means comprises an elongate curved strip.

43. A display device in accordance with claim 42 wherein the curved strip is fastened to the shaft near one perimeter of the discs and extends between the discs to emerge at a point which is spaced apart from the axis of rotation.

44. A display device in accordance with claim 41 in which the support means comprises a shaft on the axis of rotation and in which the resilient linking means comprises a wire having one end fixed to the shaft, the wire being formed to curve away from the shaft.

45. A display device unit in accordance with claim 44 in which the spacer means is located substantially between the centers of the discs and in which the fixed end of the wire is fastened to the shaft in the vicinity of the spacer means.

46. A display device in accordance with claim 1 in which the display means comprises a block having at least three surfaces of different visual appearance, the block being supported on a shaft for rotation to display each surface in succession, and in which the coupling means further comprises:

cam means coupled to the display means for driving it in rotation, the cam means having a cam surface for positioning each surface; and actuator means on the free end of the crystal drive means for engaging cam surface in succession when the drive means is actuated by an applied voltage.

47. A display device in accordance with claim 46 and further comprising:

a plurality of detent surfaces on the cam means, each detent surface corresponding to a surface of the display means; and resilient detent means having one end fixed relative to the cam means, the resilient detent means successively engaging each of the detent surfaces to hold it in display position.

* * * * *